US007717237B2

(12) United States Patent
Zamorano Morfín

(10) Patent No.: US 7,717,237 B2
(45) Date of Patent: May 18, 2010

(54) PASSENGER OR CARGO ELEVATOR

(75) Inventor: Luis Rodolfo Zamorano Morfín, Cacatúas no. 53, Frac. Lomas de las Aguilas, Delegación Alvaro Ogregón, México D.F. (MX) 01730

(73) Assignee: Luis Rodolfo Zamorano Morfin, Mexico City (MX)

( * ) Notice: Subject to any disclaimer, the term of this patent is extended or adjusted under 35 U.S.C. 154(b) by 570 days.

(21) Appl. No.: 10/575,845

(22) PCT Filed: Oct. 15, 2004

(86) PCT No.: PCT/MX2004/000076

§ 371 (c)(1),
(2), (4) Date: Apr. 6, 2007

(87) PCT Pub. No.: WO2005/035420

PCT Pub. Date: Apr. 21, 2005

(65) Prior Publication Data

US 2007/0246303 A1 Oct. 25, 2007

(30) Foreign Application Priority Data

Oct. 16, 2003 (MX) ..... PA/A/2003/009456

(51) Int. Cl.
*B66B 1/34* (2006.01)

(52) U.S. Cl. ..... 187/393; 187/264; 187/266

(58) Field of Classification Search ..... 187/250, 187/251, 252, 255, 257, 258, 264, 267, 277, 187/287, 293, 296, 297, 391–393, 262
See application file for complete search history.

(56) References Cited

U.S. PATENT DOCUMENTS

| | | | | | |
|---|---|---|---|---|---|
| 2,537,075 | A | * | 1/1951 | Margles | 187/264 |
| 3,845,842 | A | * | 11/1974 | Johnson | 187/266 |
| 4,230,205 | A | * | 10/1980 | Darwent | 187/265 |
| 4,367,810 | A | * | 1/1983 | Doane et al. | 187/280 |
| 4,455,115 | A | * | 6/1984 | Alger et al. | 414/21 |
| 4,716,989 | A | * | 1/1988 | Coleman et al. | 187/411 |
| 5,509,503 | A | * | 4/1996 | Salmon | 187/266 |

FOREIGN PATENT DOCUMENTS

| | | |
|---|---|---|
| EP | 0 924 154 B1 | 4/2003 |
| WO | WO 03/043927 A1 | 5/2003 |

* cited by examiner

*Primary Examiner*—Jonathan Salata
(74) *Attorney, Agent, or Firm*—Pillsbury Winthrop Shaw Pittman, LLP

(57) ABSTRACT

A passenger or cargo elevator is disclosed that relies on pull chains in a closed system in which the chains are used both to pull the elevator car and also to pull the counterweights. In this way, it is possible not only to use counterweights that exceed the actual weight of the elevator car, but also additional counterweights of up to 50% of the load to be lifted may be employed without incurring the problem of the chains being jerked suddenly owing to inertia during braking. The pulling motor devices, such as planetary-type speed reducers, are coupled to servomotors which can be used to program the characteristics of the movements required by the elevator. The control system includes a programmable logic controller (PLC) and a servomotor controller which, together with the coders of the servomotors, provide position, speed, and torque characteristics for operation of the system.

6 Claims, 7 Drawing Sheets

PASSENGER OR CARGO ELEVATOR

CROSS-REFERENCE TO RELATED APPLICATIONS

This is the U.S. National Stage of International Patent Application No. PCT/MX2004/000076, filed Oct. 15, 2004, which relies for priority upon Mexican Patent Application No. PA/a/2003/009456, filed on Oct. 16, 2003, the contents of both of which are incorporated herein by reference in their entireties.

BACKGROUND OF THE INVENTION

Since the invention of elevators approximately 125 years ago, both passenger and cargo elevators have been built within the following three categories: The first one, which continues to be the one most often used, is that of an elevator equipped with metal cables and electric motor systems. The second (with height limitations) is that of elevators that use hydraulic pistons, be they simple or telescopic pistons; and the third one (with greater restrictions in length of run) are those that use screws in either a direct or an indirect manner. Each one of these elevators has specific applications where their use is recommended. The first two categories can have variances of use with counterweights which significantly reduce the size of the motors and make them more efficient.

In the case of elevators equipped with traction cables, the counterweight is a very important part and it generally represents 60% of the weight of the cabin, since heavier counterweights would cause stability problems during the braking process as they are used in open elastic loops. This means that they only connect the cabin and the counterweight on the upper side of the cabin. This demands that the cabin design must have a greater inertia than that of the counterweight to avoid tugs during the process of braking. In the case of this invention, the elevator substitutes the traction cables by metal chains; in the same manner it also substitutes the traction pulleys by sprockets, but in addition it does this by means of a closed loop, which is both above and below, and by this means it ensures greater stability of the traction system.

Cable elevators have the problem that the cables stretch approximately 2% of their length. This stretching is inherent to steel cables and to the formation of the twisting of the cables (wire strands) which, when being tensed, will temporarily thin out the section of the cable, but with a tendency to permanent deformation. The progressive stretching of the cables, along with their folding on the traction pulley and on the deflecting pulley, originate cable fatigue as a result of which very high safety factors have to be used (10 to 1). In the same manner, traction pulleys have multiple grooves with the shape of the wire rope to ensure greater traction and avoid slipperiness. Nevertheless, these grooves are the result of the shape of the outstretched cable so that, when the cable has given way, it becomes a friction element causing wear between the cable and the pulley.

The constant stretching of the traction cables results in misalignments in the floor stops of the elevator thereby creating greater maintenance requirements.

The traction system hereby proposed allows the use of very heavy counterweights without creating instability during the braking process as a result of the fact that this is an inelastic closed loop. This allows a better balance between the weight of the cabin and the weight of the counterweight. In addition, it allows us to increase the counterweight up to 50% over and above the load that is to be vertically carried. This then requires less electric power to reach movement at the required speed.

In general, the traction elements of cable elevators consist of electric motors coupled with helicoidal speed reducers. These slow up the speed of the motor and increase the torque in the outgoing shaft that couples with the traction pulley. Due to the nature of the design and manufacturing process of these speed reducers, they have efficiency levels of around 80% with progressive wear since they operate through the friction of a pinion against a crown. This type of speed reducers also requires constant maintenance to avoid increasing friction coefficients to a very high level.

Elevator motors are normally electric, be they direct or alternating current, and generally in two speeds. Nowadays in elevators for great heights variable frequency motors are used to provide smoother start-ups and stops through the use of an inverter. The elevator that is the subject of the present invention uses one, two or up to four servomotors coupled to planetary-type speed reducers. These in turn spin the traction sprockets that make the traction chains move raising or lowering both the elevator cabin and the counterweight. The use of servomotors carries the benefit that we are using preprogrammable motors which have improved electrical and mechanical features for frequent starts and stops, they are compact, of variable speeds, perfectly precise, the number of turns at which they must spin can be programmed, as well as the acceleration and deceleration time or distance, maximum torque, they are reversible, have dynamic brakes and provide us with feedback of the whole of the motor's behavior by means of its servo-amplifier and encoder.

Traditional elevators are controlled by means of integrated circuits with microprocessors which receive the signals from sensors of the inductive type or micro switches that define calls or relative positions of the elevator cabin. The integrated circuits are programmed to perform the operating sequences that consist in rising, lowering (with the application of two speeds or variable speeds), and re-leveling, opening and closing doors. The elevator that is the subject of this invention modifies the control system by adopting the advantages inherent to servomotors. These, because they are intelligent motors, have already integrated the encoders and servo amplifiers which provide directly to the servomotors the start-up, acceleration, operating speed, and number of turns their shafts must perform, the programmed torque, the deceleration and stop point, in addition to obtaining a feedback of the exact behavior and the status or final position of the servomotor. Therefore, in this case there is no need for external sensors, since the whole control system of the servomotors is intrinsic to them. To control sequential movements, such as opening and closing doors, as well as calls to the elevator during its trip upwards or downwards, one uses a "programmable logic controller" (PLC) to process digital or analogical signals that can be fed into the programmable control logic with a very high level of confidence and simplicity in the program.

DETAILED DESCRIPTION OF THE INVENTION

Figure 1:
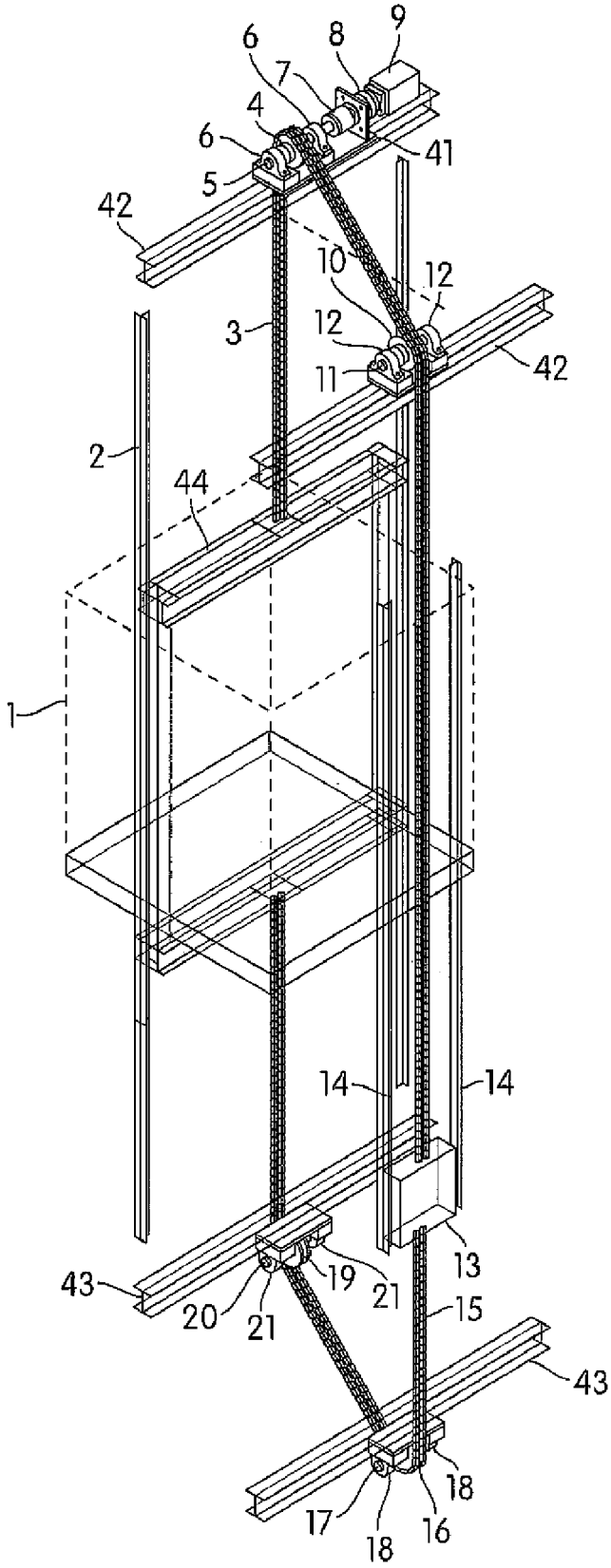
FIG. 1 shows an isometric view of the principal elements of elevator with only one traction element on the upper side.
Figure 2:
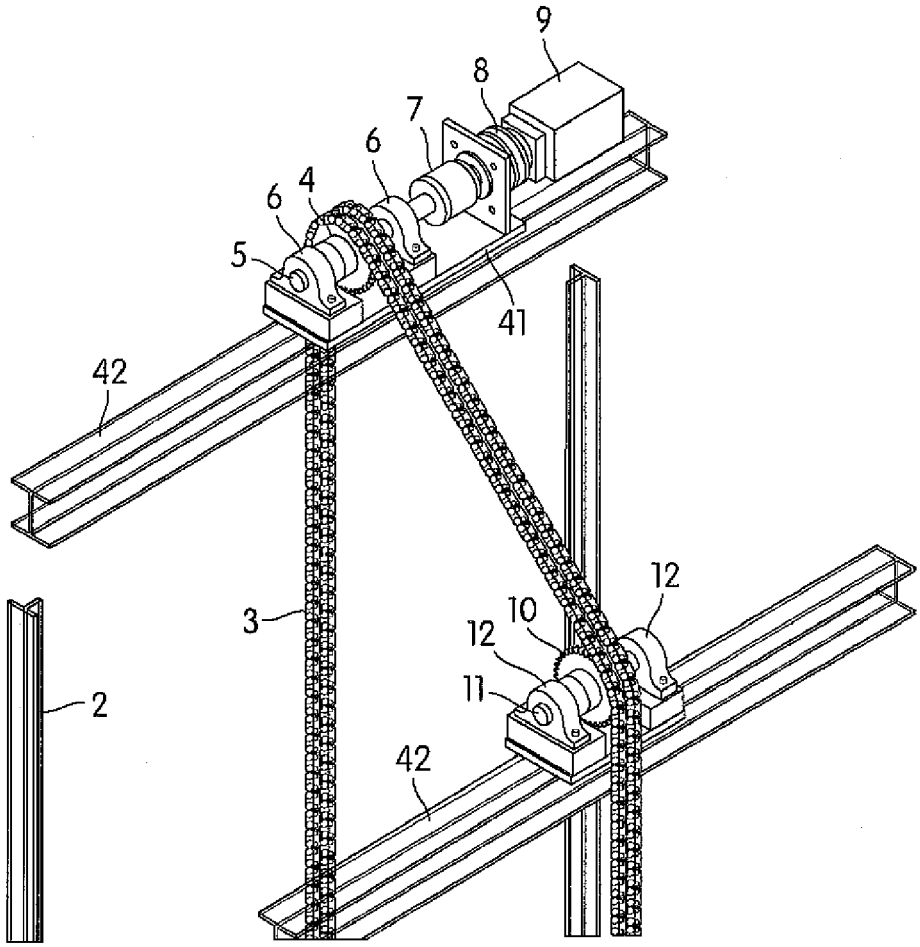
FIG. 2 shows a close-up of the motor equipment on the upper side of FIG. 1 for the purpose of having these details stand out.

Preferred Mode in FIG. 1

Figure 3:
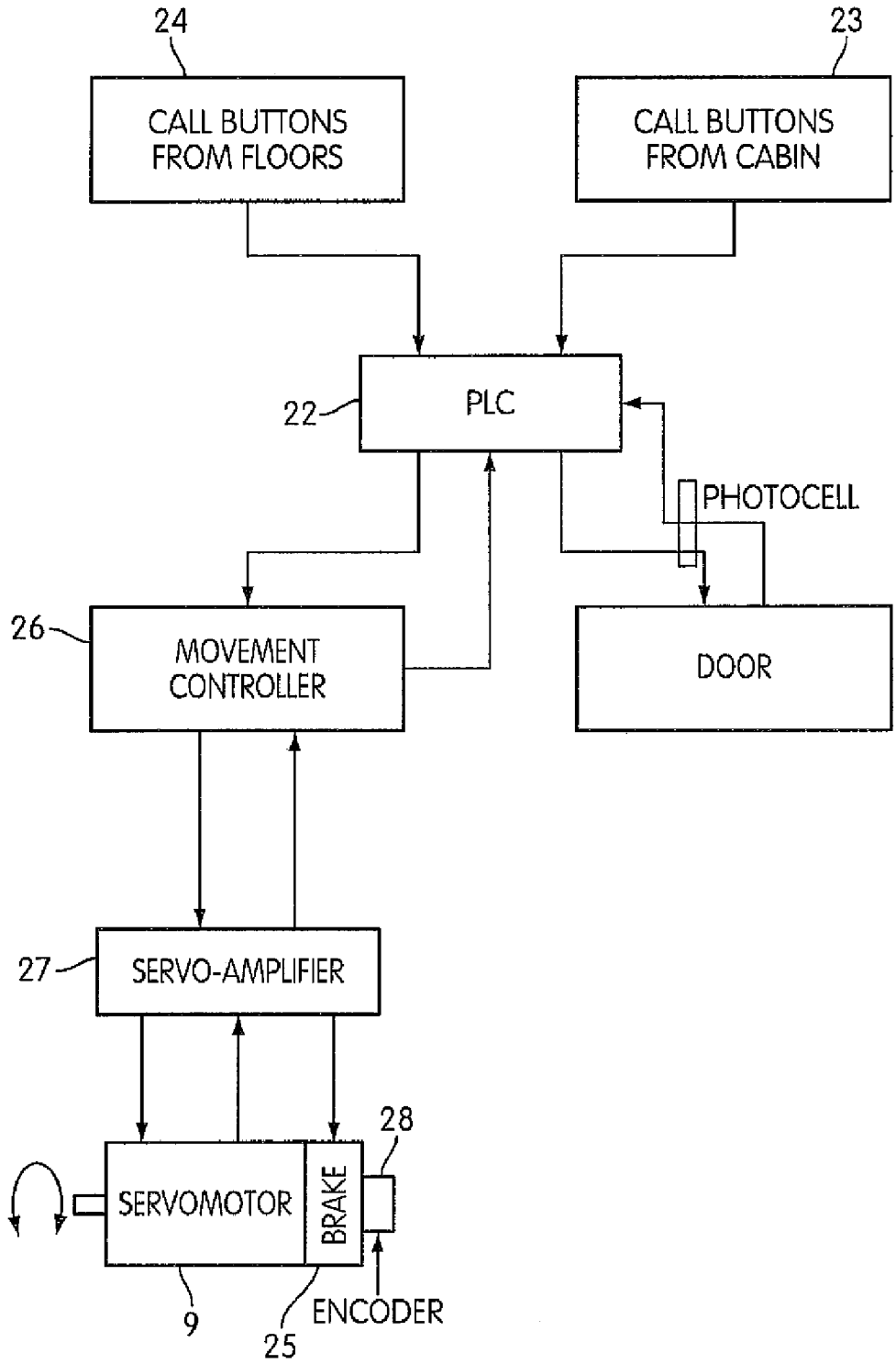
FIG. 3 shows a block diagram that shows the main elements that intervene in the control of the operating movements of the elevator.

The passenger or cargo elevator based on the use of chains, counterweights and servomotors which is the subject of this invention is referred to in FIGS. 1 and 3, and consists of the following parts: An elevator cabin (1) consisting of a platform and a structural security frame (44), on the upper part of which the traction chains will be coupled (3). The walls of the elevator cabin are not shown in the Figure in order to show the elements that lie behind it. The elevator cabin ascends and descends sliding vertically over lateral rails (2) on which four sliding shoes or aligning roller guides run (not shown in the Figure), which are firmly screwed to each of the four vertexes of the security frame (44) of the elevator cabin (1).

On the upper bridge of the elevator security frame (44) are connected two parallel chains made of steel links (3) which substitute the traditional steel traction cables of elevators. Said chains have the advantage of having a folding radius that is much smaller than that normally used for steel traction cables, which in addition have lower stretching coefficients than those normally found in steel cables, and therefore provide superior safety coefficients. Currently there exists a very large variety of transmission chains in the market depending on the type of use to be given to each one, including those types of chains that do not require lubrication because they are originally manufactured with pre-lubricated metals. The chains rise up to a traction sprocket (4) which is mounted on a horizontal shaft (5) that has two bearings (6) mounted at each end. The sprocket is firmly coupled to the traction shaft by means of wedges or any other accessory that does not allow for slippage on the traction shaft. One end of the traction shaft is coupled to the speed reducer by means of a coupling (7) the purpose of which is to absorb any linear or angular misalignment to the speed reducer shaft. Directly coupled to the speed reducer (8), which is of the planetary type, a servomotor (9) is also placed alongside which together represent the driving part of the whole elevator. All of the equipment must be mounted on a base plate (41) that is sufficiently rigid so that it can be anchored to a structure (42) that is supported by the elevator shaft or the engine room.

The chains (3), after turning on the traction sprocket (4) at an approximate angle of 270 degrees, run on a second deflecting sprocket (10) which in turn is mounted on a shaft (11) that rotates between two lateral bearings (12). Once the chains run over this deflecting sprocket they continue their vertical descending route to then be coupled to the counterweight (13) which runs vertically on the back side of the elevator cabin. The counterweight has a mass equivalent to 100% of the mass of the cabin plus 50% of the mass of the load that is to be carried. The result achieved is that the energy consumption required to lift the fully loaded cabin or that required to bring it down empty are equal. These are the maximum loads to which the traction and driving elements of the elevator will be submitted. Under these conditions in a very important manner one achieves the optimum size of the motors since these will only be calculated for 50% of the maximum load to be lifted or brought down in any of the movements of lifting or lowering. In a similar manner to that of the cabin, the counterweight is vertically guided by two rails or tracks (14) over which the shoe pads or the aligning roller guides move, common in these cases.

On the underside of the counterweight are two descending chains (15) that run vertically and turn around the third tension sprocket (16) that is firmly coupled to a shaft (17) and to two bearings (18) which are firmly anchored to another structure (43) which is anchored to the floor of the elevator pit. Once those chains turn around the tension sprocket, they rise at an angle of approximately 45 degrees to a second deflecting sprocket (19) that, in a similar manner, is firmly coupled to a shaft (20) that spins in between two bearings (21) that are also firmly anchored to the floor of the elevator well. From that point the chains (15) rise vertically up to the point of being firmly coupled to the underside of the security frame (44) of the cabin (1).

In that manner, the cabin (1), the traction chain (3), the counterweight (13), the return chain (15) and again the cabin (1) form a sliding inelastic closed loop, thereby achieving absolute precision in their relative movements and with greater equilibrium among the masses of the loads of the cabin plus the load to be lifted and the load of the counterweight.

The traction sprocket (4), which is of a smaller diameter than that of the traction pulleys for traditional cables, allows the use of higher angular speeds in the output shaft of the speed reducer, thereby requiring lower speed ratios in the gear box (8), providing it with greater efficiency. As a result in this case it is more adequate to select planetary type speed reducers rather than the helicoidal speed reducers used traditionally, and thereby increasing efficiency in over 15% versus the helicoidal type. In this way one also gains the advantage that planetary type speed reducers can transmit proportionately higher torques versus helicoidal speed reducers and permit significantly higher overload factors. The efficiency of planetary type speed reducers is generally higher than 95%, while remaining generally maintenance free and compact in size, since there are no friction elements as in the case of helicoidal speed reducers. Planetary speed reducers are reversible and generally are high precision without angle play (zero backlash). The important design advantage inherent to sprockets that are to be coupled to the traction chains is that they do not have any slippage. Therefore, there is no erosion by friction between these two elements and thereby their original conditions are maintained for a longer time.

In the case of the present elevator with servomotors, the counter-turn brakes used in traditional elevators are not required and which normally are coupled to the speed reducer box, these are substituted by a static brake (25) coupled directly to the servomotor rotor (9), i.e., on the low-torque side of the system which allows, due to its, inherent characteristics, a better coordination in the braking and freeing process which acts in only milliseconds. At the same time, when the servomotors enter into a failure situation or lack of electric energy they can be programmed so that their coils short circuit allowing the load to slide gently in a controlled manner in such a way that there are no impacts by the cabin on the upper part or against the elevator well due to excessive speeds. Similarly, the characteristics of the servomotors allow them to maintain the static position of a blocked rotor for the different stops of the elevator cabin with a load greater than one can normally obtain with the counter-turn brakes of traditional elevators.

The servomotors that have normally been designed as driving elements for highly repetitive processes have the following advantages which differentiate them from the traditional elevator electric motors: they are designed and manufactured for a very large number of starts and stops without failure of their stators due to overheating; despite the fact that their frames are more compact, they are manufactured with materials that allow for greater heat dissipation; their coils are made with thinner wires and with a greater number of them than in traditional motors thereby having a greater current density; the permanent magnets are very powerful which allows them to develop relatively high power in relatively small frames; they are of programmable frequency, voltage, torque and amperage and therefore their performance is totally predictable since they have, coupled to the extreme end of the rotor shaft, an encoder that permits us to feedback the appropriate parameters to the servo amplifier that sends to the motor the power and control in a programmed manner subject to the indications of the servomotor controller. No further details in the description of this patent are hereby provided relative to servomotors as these are of common use in industry.

The elevator controls are constituted in the manner in which they appear in FIG. 3 and basically consist of the following elements: a logic programmable controller (PLC) (22) where the programs of the logic of control and operation of the elevator reside. Its function is to register the elevator cabin command calls (23), be they from any of the floors (24) to which service is to be provided, where the "up" or "down" buttons are located, as well as inside the elevator cabin command buttons to lift or lower when pressed by the operator or by the passengers. At the same time, the PLC (22) accumulates the calls in a waiting list in a sequential manner when the elevator is in use. The control logic programs are similar to those used in traditional microprocessor integrated circuits in any type of elevator. For this reason I shall not delve further into this point and will only refer to the fact that the logic programmable control (PLC) is capable of substituting the traditional elevator controller in a more safely fashion with a greater potential use due to its universal characteristics as an element of control in any type of process. The PLC has the capability of receiving analogic and digital signals according to the requirements in each case and can send the outgoing signals in either of the two systems to the elevator driving elements.

Connected to the logic control of the PLC is the servomotor motion controller (26), which sends the start up signals to the servo-amplifier (27) which is the apparatus that provides power to the servomotor, which itself has been programmed in such a manner that the times or acceleration cycles have been established as well as maximum speed, torque and the position terms where acceleration and decelerations start and end as well as the stop function. All this is accomplished with the feedback of the encoder (28) mounted on the rotor shaft of the servomotor. One therefore obtains a closed loop of feed and feedback which allows us to establish and know the real time behavior of the system. In this sense the vertical displacement system is ruled by vertical position coordinates relative to the chain which, through the adequate conversions of the sprocket radius and the reduction ratio of the speed reducer, one obtains the conversion of coordinates to pulses of the encoder to enable it to be adequately programmed. Thus, one can appreciate that external sensors, inductive, mechanical or optical are unnecessary since the positions are achieved through the accounting of pulses registered in the encoder of the servomotor. We would only recommend external over travel sensors in the upper and lower parts of the elevator shaft in order not to depend on a single system for the safety of the elevator. Finally, the use of programmable logic controllers (PLCs) allows us to increase the reliability in safety terms connecting two PLCs in parallel, i.e., in redundancy. In the case of elevators of two or more servomotors, reliability is also increased since each servomotor has its own encoder and therefore one obtains parallel feedback signals. Current communications technology allows the PLCs to be connected to open networks with monitoring systems and the acquisition of data allows the development of diagnostics and the communication with administration systems for intelligent buildings.

Figure 4:
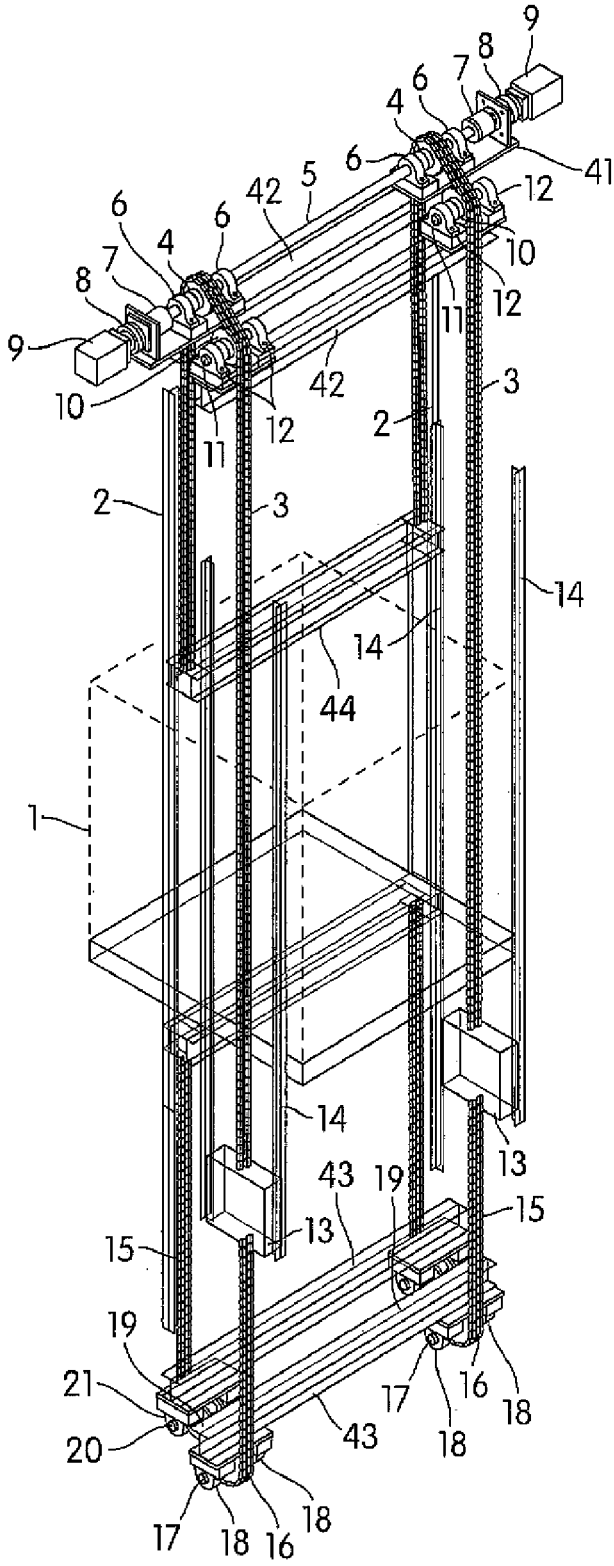
FIG. 4 shows an isometric view of the principal elements of an elevator with two traction elements on its upper side.

Mode in Reference to FIG. 4

This mode has the advantage of having two traction systems, whereby one can obtain backup of operation and provides greater reliability and availability.

Figure 6:
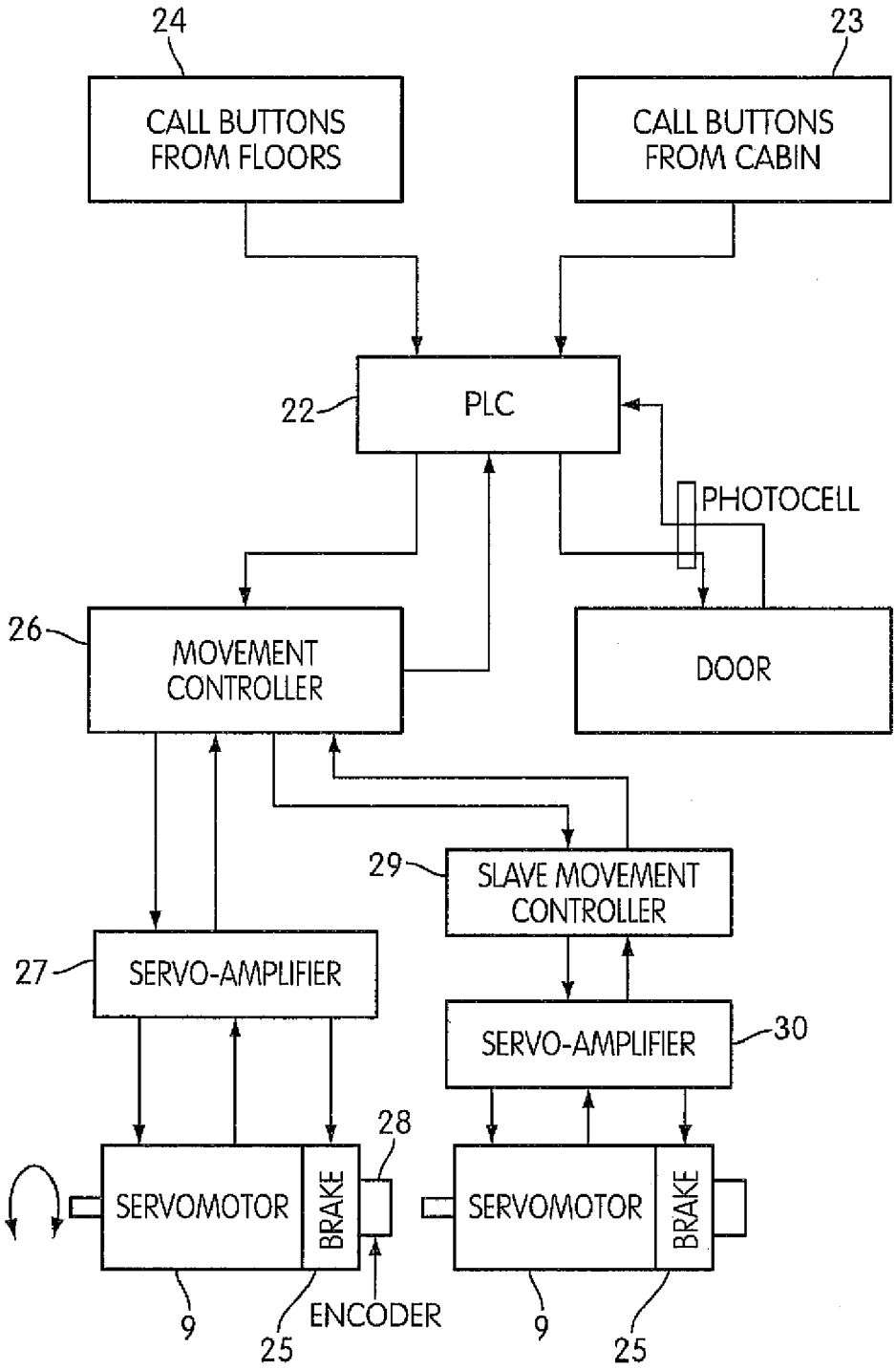
FIG. 6 shows a block diagram that shows the principal elements that intervene in the control of the operating movements of the elevator with two traction elements.

The passenger or cargo elevators based on the use of chains, counterweights and servomotors which is the subject of this invention is referred to in FIGS. 4 and 6, and consist of the following parts: An elevator cabin (1) consisting of a platform and a structural security frame (44), on the upper part of which will be coupled two sets of traction chains (3), placed at each end of the security bridge frame (44). The walls of the elevator cabin are not shown in the Figure in order to show the elements that lie behind it The elevator cabin ascends and descends sliding vertically over lateral rails (2) over which four sliding shoe pads or aligning roller guides run (not shown in the Figure), which are firmly screwed to the four vertexes of the security frame (44) of the elevator cabin (1).

On the upper bridge of the elevator security frame (44) are connected two pairs of steel chains (3) that substitute the traditional elevator steel traction cables. Said chains have the advantage of having a much smaller folding radius than that which is normally used for steel traction cables, which in addition have stretching coefficients which are lower than those normally found in the steel cables, as well as providing superior reliability coefficients. The chains rise up to two traction sprockets (4) each of which is mounted on a horizontal shaft (5) with two bearings (6) at each end. The sprockets are firmly coupled to the traction shaft by means of wedges or any other device that does not allow for slippage on the traction shafts. At each end of the traction shaft one speed reducer is coupled by means of a coupling (7) for the purpose of absorbing any linear or angular misalignment with the output shaft of the speed reducers (8). Coupled directly to each speed reducer (8), which are of a planetary type, are two servomotors (9) that together represent the driving part of the whole elevator. All this setup will be mounted on two base plates (41) that are sufficiently rigid to be anchored to a structure (42) that is supported by the elevator cube or the engine room.

After turning on the traction sprockets (4) an angle of approximately 270 degrees, the chains (3) run over two deflecting sprockets (10) which in turn are mounted on two shafts (11) where each one rotates between two lateral foot bearings (12). Once the chains run over these deflecting sprockets, they continue their descending vertical trajectories to be coupled to two counter weights (13) that run vertically in the lateral part of each extreme of the elevator cabin. The counter weights have a total mass equal to 100% of the cabin mass plus 50% of the maximum load mass that is to be transported, whereby one achieves the objective that the energy consumption to raise the cabin completely loaded or to lower it empty are equal. These therefore are the maximum load conditions to which the elevator traction and driving elements will be submitted. Under these conditions one optimizes in a very important manner the size of the driving equipment since they will only be calculated for 50% of the maximum load to be lifted or lowered in any of the rising or descending movements. In a similar way to the cabin, the counter weight is vertically guided by two rails (14) over which the sliding shoe pads or aligning roller guides run, which are common in these cases (not shown in FIG. 4), that are firmly fastened to the edges of the body of each counterweight.

In the lower part of each of the counterweights is a pair of descending chains (15) that run vertically and turn around the two inferior tension sprockets (16) each of which is firmly coupled to two shafts (17) and two bearings (18), which are firmly anchored to another structure (43) which is anchored to the floor of the elevator pit. Once these chains (15) turn around the tension sprockets, they each rise at an approximate 45 degrees angle to two inferior deflecting sprockets (19), which in a similar manner are firmly coupled to two shafts, (20) each of which rotate between two horizontal bearings (21) that are also firmly anchored to the floor of the elevator pit. From this point on, the chains (15) rise vertically until they are firmly coupled to the underside of the overhead security frame (44) of the cabin (1).

In this manner the cabin (1) the traction chains (3), the counter weights (13), the return chains (15) and, once again, the cabin (1) form an inelastic sliding closed loop thereby achieving absolute precision in its relative movements with greater equilibrium between the mass of the cabin load plus the load to be lifted and the load of the counter weights.

Since the traction sprockets (4) have a smaller diameter than the traction pulleys for traditional cables, allows the use of higher angular speeds in the output shaft of the speed reducer. This in turn results in lower reduction ratios for the speed reducers (8), resulting in greater efficiency for the speed reducer. Therefore, in this case, it becomes more appropriate to select the planetary type of speed reducers than the traditionally used helicoidal type of speed reducers, resulting in an increase in efficiency by a factor of plus 15% versus the helicoidal types. An additional advantage of the use of planetary type speed reducers is that they can also result in proportionately higher torque versus that obtainable from helicoidal speed reducers and also allow significantly higher overload factors. The efficiency of the planetary type of speed reducers is generally over 95%; in addition they are more compact, and usually do not require maintenance because they have no elements subject to friction as is the case in helicoidal type speed reducers. Planetary speed reducers are reversible, generally of very high precision and have no angular play of the teeth (i.e., zero backlash). The geometric design of the sprockets is such that they can be coupled to the traction chains without any slip. As a result there is no friction between these two elements and they are able to retain their original characteristics for a longer time.

In the present case of an elevator with servomotors, the traditional elevator counter-turn brakes are not required. These brakes are normally coupled to the speed reducer. In this case we have substituted a static brake (25) coupled directly to the servomotor rotor (9), that is in the low-torque part of the system that allows, due to its specific characteristics, an improved coordination in the process of braking and releasing which acts in milliseconds. At the same time, the servomotors, when they enter into a failure situation or a lack of electric energy, can be programmed so that their coils short-circuit thereby allowing the load to slip down very gently in a controlled manner in such a way that no impacts to the cabin can be foreseen either on its upper side or against the bottom of the elevator pit due to excessive speed. Similarly, the specifications of the servomotors themselves allow them to sustain a static blocked rotor position for each of the different stops of the elevator cabin with an even greater capacity than that obtained with the counter turn brakes of traditional elevators.

The servomotors that normally have been designed as driving equipment for highly repetitive processes have the following advantages that differentiate them from the traditional electric motors used on elevators: they are designed and manufactured for a large number of starts and stops without failure of the stators due to overheating; despite the fact that their frames are more compact, they are manufactured with materials that permit a greater heat dissipation; the coils are manufactured with thinner wires and in a larger number than in traditional motors with a greater density of electric current; the permanent magnets are very powerful which allows them to develop relatively high potencies within relatively small frames; they have programmable frequencies, voltages, torque and amperages so that their performance is completely predictable and having at the extreme back end of the rotor shaft an encoder that allows us to feed back the appropriate parameters to the servo amplifier that sends to the motor the power and control current in a controlled and programmed manner in line with the controller signals of the servomotor. No further details in the description of this patent are hereby provided relative to servomotors as these are of common use in industry.

The elevator controls are structured as they appear in FIG. 6 and basically consist of the following elements: a logic programmable controller (PLC) (22), where the programs of the logic of control and operation of the elevator reside. Its function is to register the elevator cabin command calls (23), be they from any of the floors (24) to which service must be provided, where the "up" and "down" buttons are located, as well as the command call buttons of the cabin itself to raise or lower the elevator as they are pressed by the elevator operator or the passengers. At the same time, the PLC (22) accumulates in sequential order in its waiting memory the calls that come in while the elevator is in operation. The control logic programs are similar to those used in traditional microprocessor integrated circuits in any type of elevator. I shall therefore not delve further into this point and will only refer to the fact that the PLC has the capability of substituting the traditional elevator controls in a more reliable manner and with greater potential uses due to its universal characteristics as a control element in any type of process. The PLC has the capacity to receive both analogic and digital signals according to the needs of each case and can send outgoing signals in either system to the elevator's driving elements.

The master motion control of the servomotor (26) is connected to the control logic of the PLC which in turn communicates and commands in parallel the slave controller (28) which sends the start up signals to the servo amplifier (27) and (29) which are the elements that provide the servomotors with programmed power in such a way that they operate in synchrony so as to define the times or cycles for acceleration, maximum speed, torque and the conditions of the positions where acceleration and deceleration start and end as well as the stop. All of these conditions are met by the feedback of the encoders (28) mounted on the rotor shaft of each servomotor. One thereby obtains a closed loop in feed and feedback that permits us to establish and know the real performance of the system. In this sense the vertical displacement system is ruled by the vertical coordinates of the relative position of the chains which, through the adequate conversions, as a result of the radius of the sprockets and the reduction ratio of the speed reducers, one obtains the conversion of coordinates in the form of pulses from the encoders so as to permit proper programming. As one can readily appreciate, the external sensors, be they inductive, mechanical or traditional optic sensors are no longer necessary since the positions can be obtained through the accounting of the pulses registered with the encoder of the master servomotor with the redundancy of the slave encoder. External overtravel sensors would only be recommended in the upper and lower side of the elevator pit so as not to depend on only one system for the safety of the elevator. Finally, the use of PLCs allows us the increase in reliability in terms of safety connecting two PLCs in parallel, i.e., in a redundant manner. In the case of elevators with two or more servomotors, safety is also increased since each servomotor is equipped with its own encoder and therefore one can obtain feedback signals in parallel. Current PLC technology allows PLCs to be connected to open networks with monitoring systems and the acquisition of data that permits diagnosis and communications with the administration systems of intelligent buildings.

Figure 5:
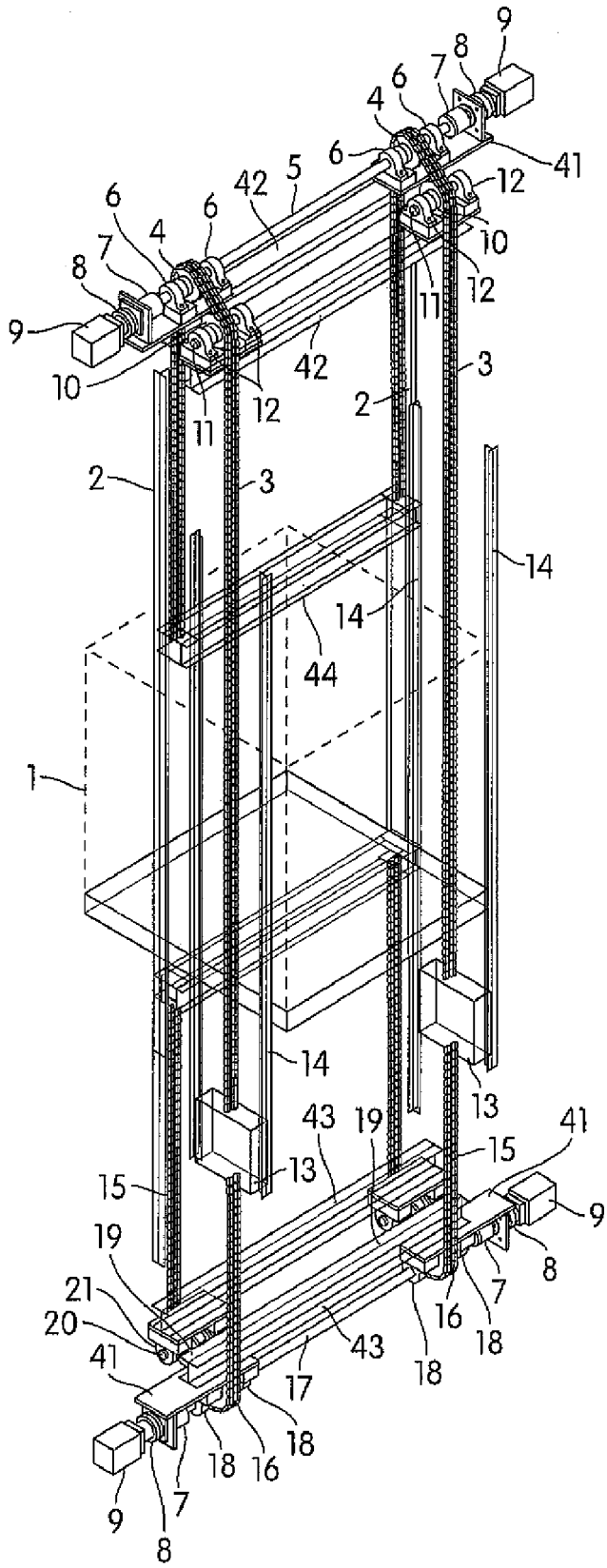
FIG. 5 shows an isometric view of the principal elements of an elevator with four traction elements, two on the upper side and two on the inferior side.

Mode in Reference to FIG. 5

This mode has the advantage of having four speed reducers and four servomotors which provides the system with a greater degree of reliability by virtue of the fact that it can operate with one or two systems disconnected (one on each side) at half the speed, in addition to allowing the selection of smaller traction equipments within commercial ranges.

Figure 7:
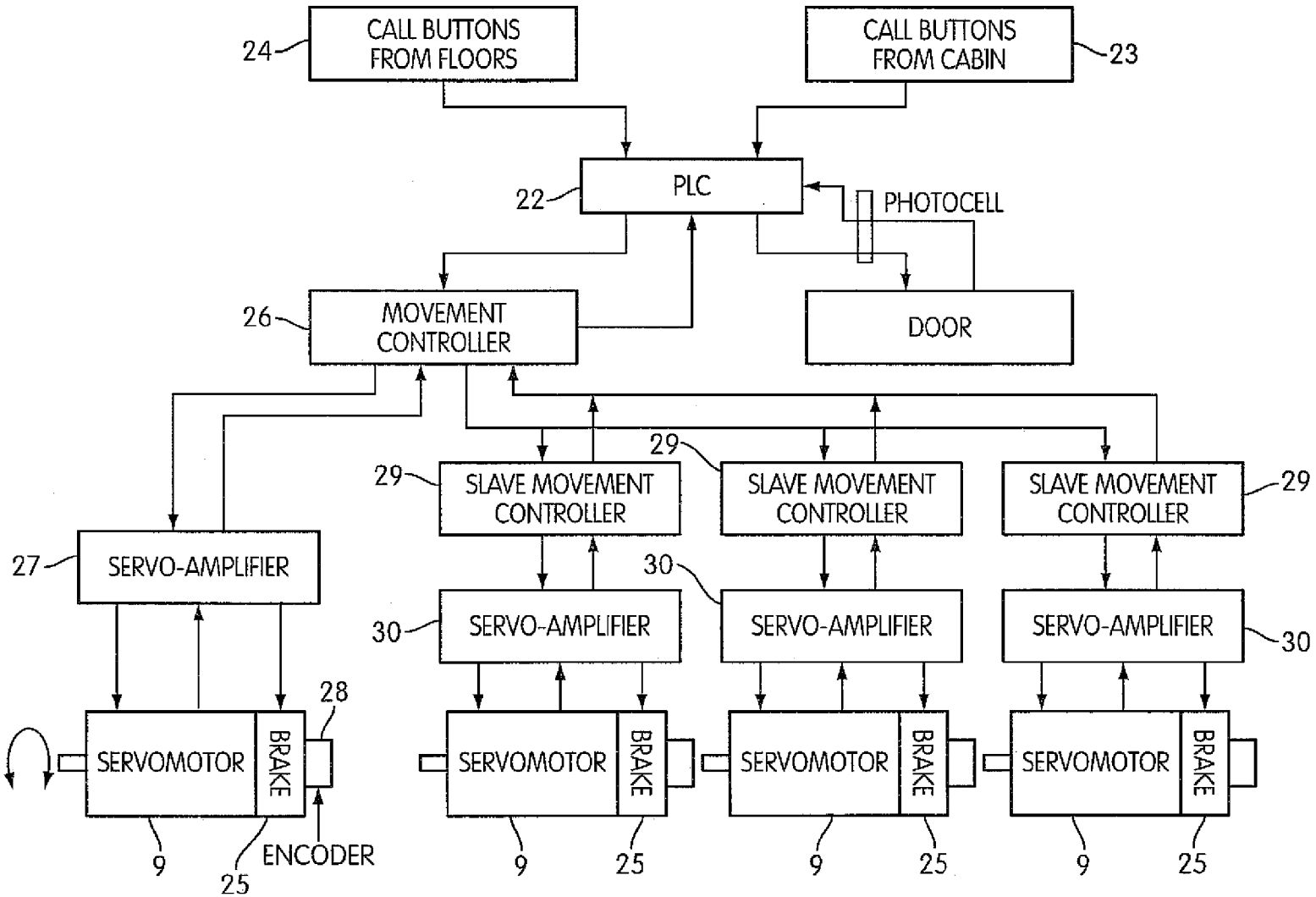
FIG. 7 shows a block diagram that shows the principal elements that intervene in the operating movements of an elevator with four traction systems.

The cargo or passenger elevator based on the use of chains, two counterweights and four servomotors with speed reducers (two servomotors that pull the elevator cabin and two underneath that pull the counterweights) is described and referred to in FIGS. 5 and 7 and consists of the following parts: An elevator cabin (1) consisting of a platform and a structural-type safety frame (44), on the upper part of which are located two sets of traction chains (3) placed on the extreme edges of the safety frames (44). The walls of the elevator cabin are not shown in the Figure with the object of being able to show the elements that will lie behind it. The elevator cabin rises and descends sliding vertically over lateral rails (2) over which four sliding shoe pads or aligning roller guides run (not shown in the Figure) that are firmly screwed on to the four angle vertexes of the security frame (44) of the elevator cabin (1).

On the upper bridge of the elevator safety frame (44) are connected two pairs of two parallel steel link chains (3) substituting the traditional steel tractor cables of traditional elevators. Said chains have the advantage of having a much smaller folding radius than that normally used for traction cables, in addition to having smaller stretch coefficients than those normally found in steel cables. Thus, they provide superior safety ratings. The chains rise up to the two overhead traction sprockets (4) that are each mounted on a horizontal shaft (5) and two bearings on the extreme ends (6). The sprockets are firmly coupled to the traction shaft with wedges or any other device that will not allow the traction shafts to slip. At each end of the traction shaft one speed reducer is coupled by means of a coupling (7) for the purpose of absorbing any linear or angular misalignment with the output shaft of the speed reducers (8). Coupled directly to each planetary-type speed reducer shaft (8) are two servomotors (9) which together represent the whole driving part of the elevator. This whole arrangement must be mounted on two metal bases (41) that are sufficiently rigid and that are anchored to a structure (42) that is supported by the elevator shaft or to the machine room.

After turning over the tractor sprockets (4) an angle of approximately 270°, the chains (3) run over two deflecting sprockets (10) which are mounted on two shafts (11) that each rotate between two lateral foot bearings (12). Once the chains pass over these deflecting sprockets, they continue their vertical descending trajectories to be coupled to two counterweights (13) that run vertically in the lateral part at each end of the elevator. The counterweights have a total mass equivalent to 100% the mass of the cabin plus 50% of the load mass that is to be transported. Through this method we achieve that energy consumption to raise the cabin fully loaded or to lower it empty are equal. These would be the conditions of maximum load to which the traction and driving elements would be submitted. Under these conditions we optimize in a very important manner the size of the driving equipment required since these will only be calculated for 50% of the maximum load to be raised or lowered under any of the rising or lowering movements. The counterweight, in a similar manner to that of the cabin, is guided vertically by two rails (14) over which the sliding shoe pads or aligning roller guides run (not shown in FIG. 5), normal in these cases, which are firmly screwed on to the edges of the body of each counterweight.

In the lower part of each of the counterweights is a pair of descending chains (15) that run vertically and turn around the two traction sprockets (16) that are mounted over the horizontal shaft (17) and the two bearings (18) at each end of each sprocket. The sprockets are firmly coupled to the traction shaft by means of wedges or any other device that does not allow slippage of the traction shafts. At the extremes of the traction shaft, it is coupled with two speed reducers via two couplings (7) that are designed to absorb any misalignment, either linear or angular, with the output shaft of the speed reducers (8). Coupled directly on to each speed reducer (8), both of which are of the planetary type, are two servomotors (9). This whole ensemble must be mounted onto two base metal plates (41) of sufficient rigidity and which will be anchored on to a structure (43) that is anchored on to the bottom of the elevator shaft. Once the chains (15) turn around the lower tractor sprockets, they rise at an approximately 45° angle up to two lower deflecting sprockets (19) which, similarly, each one is firmly coupled to two shafts (20) that spin between two horizontal bearings (21) and that are also firmly anchored to the bottom of the elevator shaft. As of this moment, the chains (15) rise vertically up to the point of being firmly coupled to the lower part of the upper bridge of the safety frame (44) of the cabin (1).

In this manner the cabin (1), the traction chains (3), the counterweights (13), the return chains (15) and again the cabin (1), form a non-slip, inelastic closed loop thereby achieving absolute precision in their relative movements and with a greater equilibrium between the masses of the cabin loads, plus the load to be lifted and the load of the counterweights.

The traction sprockets (4) and (16), since they are of a smaller diameter than the traction pulleys for traditional cables, allow the maintenance of higher angular speeds in the output shaft of the speed reducer. This means that lower reduction ratios are required in the speed reducers (8) thereby providing them with greater efficiency. As a result, the selection of planetary speed reducers in this case is better than the helicoidal speed reducers used on traditional elevators increasing by over 15% the efficiency of use of these versus the helicoidal type. In addition one gains the advantage that planetary type speed reducers can deliver proportionally higher torque compared to helicoidal reducers and allow for significantly higher overload factors. Generally, the efficiency of planetary type speed reducers is over 95%. In addition, they are compact and generally do not require maintenance since they do not have elements subject to friction as do helicoidal reducers. Planetary speed reducers are reversible and generally are of very high precision with no angular play between the gear teeth (i.e., zero backlash). The basic design of the sprockets to enable them to be coupled to the traction chains does not allow for any slippage so there is no wear due to friction between these two elements thereby maintaining their original conditions for a longer period of time.

In the present case of an elevator with servomotors, the counter-turn brakes used in traditional elevators that are normally coupled to the speed reducer are not required. Instead we have a static brake (25) coupled directly to the servomotor rotor (9), that is on the low torque side of the system which allows, due to its inherent characteristics, the achievement of better coordination in the process of braking and freeing up in the matter of milliseconds. In the same manner, the servomotors when under conditions of failure or of no electric power can be programmed so that their coils are short-circuited thereby allowing the load to slowly slide in a controlled manner such that impacts against the cabin on its upper part or on the floor of the elevator shaft are not foreseen due to excessive speed. In the same manner, the specific characteristics of the servomotors allow them to retain the static position of a blocked rotor for the different stops of the elevator cabin with an even greater capability than is obtained in the traditional elevator counter-turn brakes.

Servomotors have been designed as motor equipment for highly repetitive processes. They have the following advantages that make them different from the traditional electric motors of traditional elevators: They are designed and manufactured for a large number of stops and starts without the stators going into an overheating condition. Despite the fact that they have more compact frames, they are manufactured with materials that allow greater heat dissipation. Their coils are manufactured with thinner wires and with a greater number of wires than in traditional motors thereby providing greater current density. Their permanent magnets are very powerful, a feature which allows them to develop relatively high potencies in relatively small frames. They have programmable frequencies, voltage, torque and amperage so that their performance is completely predictable having, at the extreme back end of the rotor shaft, an encoder that allows us to feed back all of these parameters to the servo amplifier and which sends the electric current in the potency and controlled manner as programmed in line with the signals of the servomotor controller. In this patent we do not provide any further details relative to servomotors since these are commonly used in industry.

The elevator controls are positioned as they appear in FIG. 7 and are basically structured with the following elements: a programmable logic controller (PLC) (22), wherein resides the program that controls the logic and the operation of the elevator and has, as its basic function, that of registering the command calls for the elevator cabin (23), be they from any of the floors (24) which it services, from the "up" and "down" buttons on the inside of the cabin, as well as from the cabin button commands to go up or down when pressed by the elevator operator or by the passengers. In the same manner, when the elevator is in operation, the (PLC) (22) accumulates the calls in its memory in a sequential waiting list. The control logic programs are similar to those used in the integrated circuits of the traditional microprocessors of any type of elevator. For that reason I shall not delve further into this point and only refer to the fact that the PLC has the capability to substitute the controls in traditional elevators in a safe manner and with a greater potential use (than the integrated circuits) due to its universal characteristics as a control element in any type of process. The PLC has the capability of receiving both analogic and digital signals in accordance to the needs in each case and of sending outgoing signals in either of the two systems to the driving elements of the elevator.

The motion control of the movements of the servomotors (26) are connected to the logic control of the PLC which in turn communicates and commands the slave controls (28) in parallel. This in turn sends the start-up signals to the servo amplifier (27 and 30) which are the devices that provide power to the servomotors which have been programmed to function in synchrony with the times or acceleration cycles, maximum speed, torque and position terms where the accelerations start and decelerations end as well as with the stop points. All of the previous actions occur with the feed back of the encoders (28) mounted on the rotor shaft of the servomotor. The result is a closed loop of feed and feedback that allows us to establish and to know the real behavior of the system. In this sense, the vertical displacement system is ruled by the vertical coordinates of the relative position of the chains which, through the adequate conversions based on the radius of the sprockets and the reduction ratio of the speed reducers, provide the conversion from coordinates to pulses of the encoders for their proper and correct programming. As can be appreciated, no longer required are the traditional external sensors, either inductive or mechanical or optical, since all of the positions are achieved through the accounting of the pulses registered in the encoder of the master servomotor with a redundancy in the slave encoders. One would only recommend external over-travel sensors in the upper and lower part of the elevator shaft for the purpose of not depending on only one system for the safety of the elevator. Lastly, the use of programmable logic controllers (PLCs) provides us with the possibility of increasing the reliability in terms of safety connecting two PLCs in parallel, i.e., redundant. In the case of elevators with two or more servomotors, we also increase reliability and safety since each servomotor has its own encoder and therefore obtains feedback signals in parallel. Current communications technology permits the PLCs to be connected to open networks with monitoring systems and the acquisition of data that allows for diagnostics and communication with the administration systems for intelligent buildings.

The invention claimed is:

1. A passenger or cargo elevator or lift based on chains, counterweights and servomotors of the type having a cabin that is transported vertically; said elevator comprising:

at least one traction system comprising a set of traction chains;

a set of traction sprockets mounted on a first shaft that rotates between two bearings and which is connected by a flexible coupling to at least one planetary speed reducer to which at least one servomotor with a brake is connected;

a set of upper tension sprockets;

at least one counterweight equivalent to a weight of said cabin plus approximately 50% of the maximum load to be transported;

a second set of descending chains connecting the at least one counterweight to a lower part of said cabin;

a second set of lower tension sprockets firmly mounted on a second shaft that revolves between two bearings that are each supported by a structure anchored to an elevator pit;

a third set of lower tension sprockets that are mounted on a third shaft that revolves between two bearings that are firmly anchored to a structure placed in the elevator pit;

a power and control system comprising a programmable logic controller (PLC) that receives command calls from call buttons both on building floors, where the elevator operates and a call button in the elevator cabin; said power and control system adapted to send commands to a motion controller for said at least one servomotor which, based on predetermined parameters, orders at least one servo-amplifier to feed electric power to said at least one servomotor and associated brake in order that it performs a predetermined operation;

said elevator further including an encoder mounted on the first shaft of its corresponding servomotor; the encoder configured to provide control pulses and feedback to said servo-amplifier and said PLC about operations performed by the at least one traction system.

2. The elevator according to claim 1, further comprising two speed reducers and upper traction servomotors coupled to the traction sprockets to pull up said cabin or said elevator counterweights; said elevator having two identical traction systems, wherein one of the motion controllers for the servomotors is of the master type and the other one is of the slave type.

3. The elevator according to the claim 2, wherein one of said two traction systems can be used as a back-up of the other one, so that said elevator can operate, even if one of the motors fails, by modifying the operating speeds.

4. The elevator according to claim 1, further comprising two upper speed reducers and traction servomotors coupled to the first traction sprockets and two lower speed reducers and traction servomotors coupled to the second set of traction sprockets, said upper and lowers speed reducers and servomotors pulling said cabin and said elevator counterweights upwardly or downwardly; said elevator further comprising four identical traction systems, wherein one of the motion controllers for the servomotors is of the master type and the other motion controllers are of the slave type.

5. The elevator according to claim 4, wherein two of said traction systems can act as back-up for the other two traction systems so that said elevator can operate, even if one or two of said traction systems fails, modifying only the operating speeds.

6. An elevator system comprising:

a cabin;

a counterweight;

a first set of chains connecting a first part of said cabin to the counterweight, the first set of chains being driven by at least one traction sprocket connected to a servomotor having a brake;

a second set of chains connecting the counterweight to a second part of said cabin; the second set of chains connected to at least one tension sprocket anchored in an elevator pit;

a power and control system comprising a programmable logic controller (PLC) that is configured to send commands to the servomotor and the brake in order to perform a predetermined operation; and an encoder associated with the servomotor that is configured to provide control pulses and feedback to the servomotor and the PLC.

* * * * *